US008286714B2

(12) United States Patent
Ellis et al.

(10) Patent No.: US 8,286,714 B2
(45) Date of Patent: Oct. 16, 2012

(54) RISER TENSIONER WITH SHROUDED RODS

(75) Inventors: Fife B. Ellis, Houston, TX (US); Joseph W. Pallini, Tomball, TX (US); Jeffery K. McCarty, Houston, TX (US); Charles E. Jennings, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 319 days.

(21) Appl. No.: 12/715,552

(22) Filed: Mar. 2, 2010

(65) Prior Publication Data

US 2010/0158615 A1 Jun. 24, 2010

Related U.S. Application Data

(63) Continuation of application No. 11/507,865, filed on Aug. 22, 2006, now abandoned, which is a continuation-in-part of application No. 11/020,857, filed on Dec. 23, 2004, now abandoned.

(60) Provisional application No. 60/534,831, filed on Jan. 7, 2004.

(51) Int. Cl.
*E21B 19/09* (2006.01)

(52) U.S. Cl. ..... 166/355

(58) Field of Classification Search ..... 166/355; 405/224.2, 224.4, 195.1
See application file for complete search history.

(56) References Cited

U.S. PATENT DOCUMENTS 4,432,420 A * 2/1984 Gregory et al. ..... 166/355
5,252,005 A * 10/1993 Koos ..... 405/224.4
6,655,569 B1 * 12/2003 Greenhill et al. ..... 227/9

FOREIGN PATENT DOCUMENTS

WO WO 9319280 A1 * 9/1993

* cited by examiner

*Primary Examiner* — Sunil Singh
(74) *Attorney, Agent, or Firm* — Bracewell & Giuliani LLP

(57) ABSTRACT

A surface assembly that communicates with subsea structures and includes a working deck on a floating structure. The working deck has an aperture extending axially therethrough. A riser extends from a subsea location to the working deck and through the aperture. The surface assembly includes a frame extending circumferentially around the riser so that the frame moves axially with the riser. The assembly also includes a tensioner assembly connected between the working deck and the frame. The tensioner assembly includes a piston slidably carried in a piston chamber, a piston rod extending from the piston and away from the piston chamber, and a shroud enclosing the piston rod. The shroud has a plurality of segments with at least one of the shroud segments being movable in unison with the piston rod.

15 Claims, 9 Drawing Sheets

RISER TENSIONER WITH SHROUDED RODS

RELATED APPLICATIONS

This is a continuation of U.S. patent application Ser. No. 11/507,865 filed Aug. 22, 2006, now abandoned, which is a Continuation-in-part of U.S. patent application Ser. No. 11/020,857 filed Dec. 23, 2004, now abandoned, which claims priority to U.S. Provisional Patent Application Ser. No. 60/534,831 filed Jan. 7, 2004, which is hereby incorporated by reference in its entirety.

BACKGROUND OF THE INVENTION

1. Field of the Invention

This invention relates in general to hydro/pneumatic tensioners for applying tension to a riser supported from a floating platform.

2. Background of the Invention

An offshore facility includes a riser extending to a subsea facility such as a subsea well or subsea manifold located at the sea floor. Offshore facilities that float, such as a tension leg platform, move up and down and horizontally relative to the subsea well with the oscillations of the waves and currents. It is often desirous to maintain a desired tension on the riser during these oscillating movements. Tensioners are often utilized in order to react to the movements of offshore facilities moving with the wave oscillations and currents.

Previous tensioner assemblies, like those on tension leg platforms, include a plurality of piston assemblies suspended from a deck that connect to a tension ring surrounding the riser. One type relied upon gas positioned in a chamber surrounding the piston rod to create tension. These piston assemblies are pull-type piston assemblies because they react when the piston is being pulled through the piston chamber and the fluid surrounding the piston rod is compressed. These assemblies require large piston assemblies to accommodate the necessary fluid for creating tension in reaction to the movements of the platform.

Other previous tensioner assemblies include ram style or push-type piston assemblies that have the reactive fluid on the side of the piston opposite from the piston rod. Ram style piston assemblies react when the piston is being pushed through the piston chamber. This arrangement allows for smaller piston assemblies because there is no piston rod in the chamber containing the fluid. Moreover, in previous assemblies, the piston rod extends downward to the piston housed with the piston chamber. Therefore, drippings and debris from above often fall onto the piston rods which can damage the seals of the piston assembly. Failure and less reactive tensioning can occur when the seals are damaged.

In other ram style or push-type piston assemblies, the piston rod extends upward to the piston housed with the piston chamber. In these assemblies, drippings and debris fall from above onto the rods. Such an arrangement typically required expensive coatings to be applied to the outer surface of the piston rods that were exposed to the elements.

SUMMARY OF THE INVENTION

A surface assembly that communicates with subsea structures includes a working deck on a floating structure. The working deck has an aperture extending axially therethrough. A riser extends from a subsea location to the working deck. The riser extends through the aperture. The surface assembly includes a frame extending circumferentially around the riser. The frame is connected to the riser so that the frame moves axially with the riser. The assembly also includes a tensioner assembly connected between the working deck and the frame. The tensioner assembly comprises a piston, a piston chamber, a sealing portion between the piston and the piston chamber, a piston rod extending from the piston and away from the piston chamber, and a shroud enclosing the piston rod and at least the sealing portion of the piston assembly.

In another configuration, the sealing portion is between the piston and an interior surface of the shroud. A piston chamber is defined by the sealing portion, the piston, and the shroud. The tensioner assembly can also include a cylinder. The sealing portion can then be located between the piston and the cylinder. The piston chamber is then defined by the sealing portion, the piston, and the cylinder. The shroud typically has a closed upper end, and an open lower end that exposes a portion of its interior surface to atmospheric pressure.

In yet another configuration, a surface assembly for subsea wells includes a working deck on a floating structure. The working deck has an aperture extending axially therethrough. A riser extends from a subsea location to the working deck and through the aperture. A frame extends circumferentially around the riser. The frame is connected to the riser so that the frame moves axially with the riser. A tensioner assembly is connected between the working deck and the frame. The tensioner assembly includes a piston slidably carried in a piston chamber, a piston rod extending from the piston and away from the piston chamber, and a shroud enclosing the piston rod. The shroud has a plurality of segments with at least one of the shroud segments being movable in unison with the piston rod.

The plurality of segments can include an inner shroud segment being stationary relative to the piston rod. The plurality of segments can have an inner shroud segment and an outer shroud segment, with the outer shroud segment telescoping over the inner shroud segment when the tensioner assembly is in a contracted position. A substantial portion of the inner shroud segment can be uncovered when the tensioner assembly is in an extended position. Either the outer shroud segment or the inner shroud segment that is fixedly connected to an end portion of the piston chamber that receives the piston rod.

The plurality of segments can also include an intermediate shroud segment. The intermediate shroud segment telescoping over the inner shroud segment when the tensioner assembly is in a contracted position, and the outer shroud segment telescoping over the intermediate and inner shroud segments when the tensioner assembly is in a contracted position.

In another configuration a riser tensioner assembly for maintaining tension in a riser extending from a subsea well through an aperture in a working deck of a floating structure includes a piston slidably carried in a piston chamber. A piston rod extends from the piston chamber. The piston rod and piston are movable between a contracted position and an extended position of the tensioner assembly. A shroud surrounds at least part of the piston rod while in the contracted and extended positions. The shroud has a plurality of shroud segments with at least one of the shroud segments being movable in unison with the piston rod and at least one of the shroud segments being fixedly connected to an end portion of the piston chamber that receives the piston rod.

In the tensioner assembly, the plurality of shroud segments can include an inner shroud segment and an outer shroud segment. The inner shroud segment can have a flange end connected to either the piston chamber or the piston rod and a telescoping end having an outer lip. The outer shroud can also have a flange end connected to the other of the piston chamber or the piston rod and a telescoping end having an inner lip.

When the tensioner assembly is in the extended position, the outer lip of the inner shroud engaging another shroud segment telescoping over the inner shroud and the inner lip of the outer shroud engaging another shroud segment telescoping within the outer shroud.

The plurality of shroud segments can also include an intermediate shroud segment. The intermediate shroud segment telescopes over the inner shroud segment when the tensioner assembly is in a contracted position. The outer shroud segment telescopes over the intermediate and inner shroud segments when the tensioner assembly is in a contracted position.

Each intermediate shroud segment can have an extension end and a contraction end. The extension end has an outer lip and the contraction end has an inner lip. When the tensioner assembly is in the extended position the outer lip of the intermediate shroud segment engages an interior lip of either another intermediate shroud segment or the outer shroud segment, and the inner lip of the intermediate shroud segment engages an outer lip of either another intermediate shroud segment or the inner shroud segment.

DETAILED DESCRIPTION OF THE PREFERRED EMBODIMENT

Figure 2:
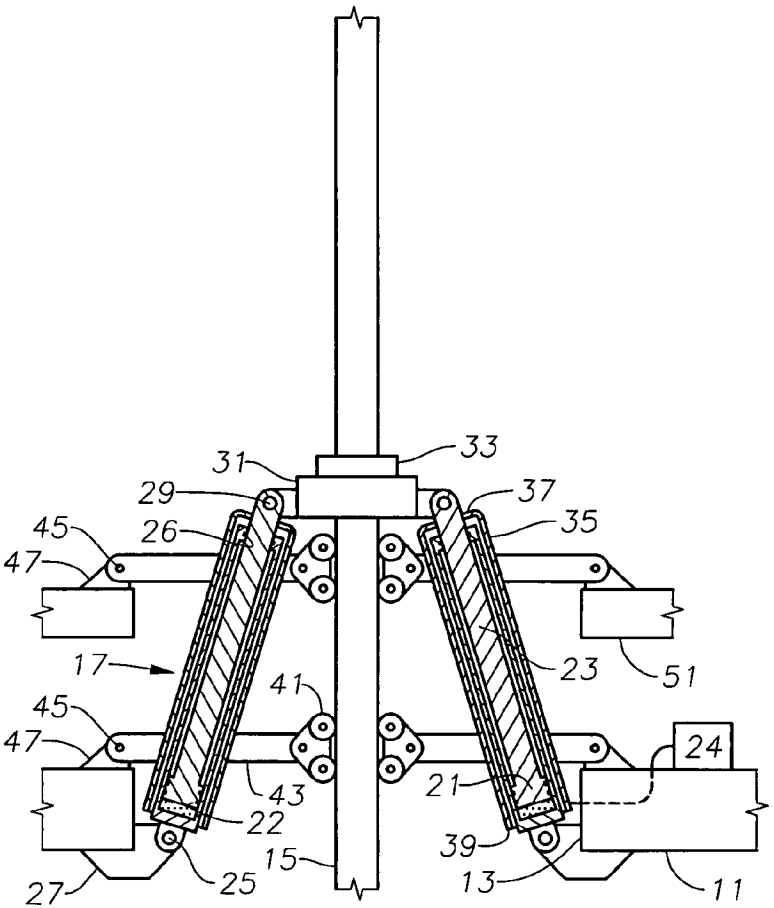
FIG. 2 is a schematic side view of the riser tensioner in FIG. 1, shown in a contracted position.
Figure 1:
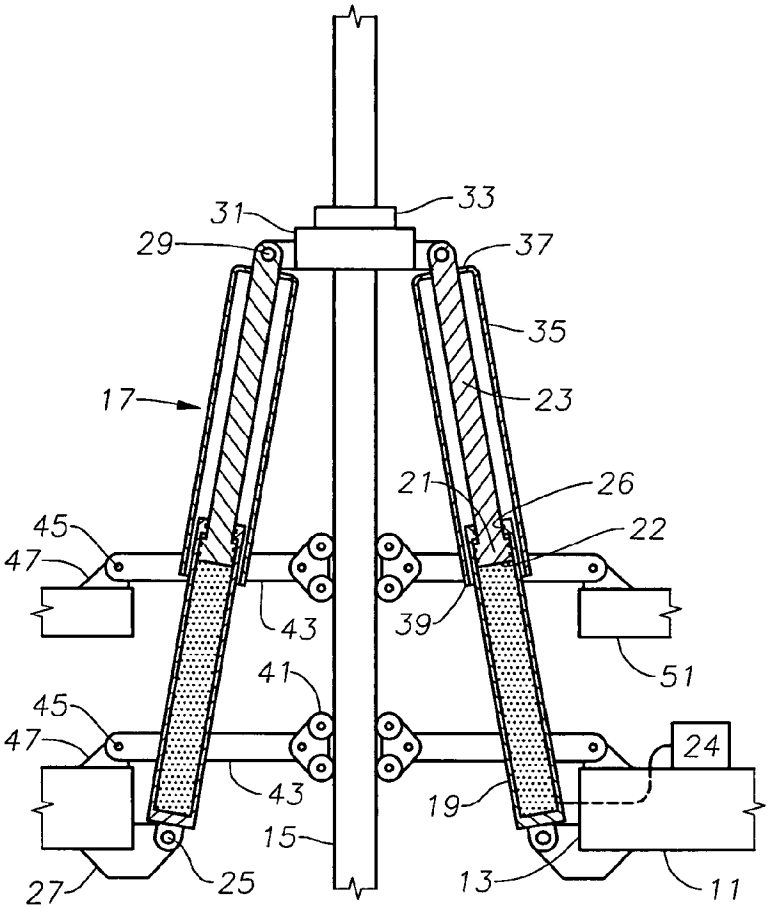
FIG. 1 is a schematic side view of a riser tensioner constructed in accordance with this invention and shown in an extended position.

Referring to FIGS. 1 and 2, a floating platform deck 11 is schematically shown. Deck 11 may, for example, be a deck of a barge, a tension leg platform, a spar or other types. However, the arrangement of FIG. 1 is particularly suited for a spar. Deck 11 has an opening 13 through which a riser 15 extends.

Riser 15 is connected on its lower end to a subsea well. In this embodiment, riser 15 is a production riser. Typically, a production tree (not shown) is mounted to the upper end of riser 15. Well fluids flow from the subsea wellhead of production riser 15 to the tree. Typically, the floating platform will support a number of risers 15.

A tensioner assembly comprising a plurality of hydro/pneumatic cylinder assemblies 17 supplies tension to each riser 15 as deck 11 moves upward and downward. Two cylinder assemblies 17 are shown in FIG. 1, but preferably, at least two more cylinder assemblies 17 will provide tension to each riser 15. Each cylinder assembly 17 includes a cylinder 19 and a piston 21 that strokes within cylinder 19. Piston 21 has a rod 23 that protrudes from one end of cylinder 19. In this embodiment, rod 23 is located on the upper end of cylinder 19 above deck 11. A closed system of pressurized gas over fluid is utilized to provide force. The pressurized fluid and gas may be internal or external to the cylinder. Both internal and external sources may be used together. An external pressurized fluid and gas source or accumulator 24 is shown. If desired, fluid under atmospheric or low pressure may be placed in the annular space surrounding rod 23 above piston 21 to serve as lubricant for piston 21. The lubricant may lead to a reservoir for maintaining a constant supply as piston 21 strokes up and down.

In the preferred embodiment, a plurality of seals 22 surround the circumference of piston 21. In the embodiment shown in FIGS. 1 and 2 seals 22 engage an interior surface of cylinder 19. A piston chamber is defined by piston 21, seals 22 and cylinder 19. In the embodiment shown in FIGS. 1 and 2, a plurality of seals 26 also extend from cylinder 19 to sealingly engage rod 23.

Cylinder 19 is connected on its lower end to a brace 27 by a pin 25. In the preferred embodiment, pin 25 is spherical so as to allow pivotal rotation not only in the plane containing the drawing, but also in a Z-plane perpendicular to the plane containing the drawing. Brace 27 in this embodiment is secured to deck 11, and the lower ends of cylinders 19 are located approximately at the same level as deck 11.

Each cylinder assembly 17 inclines relative to riser 15 and deck 11 in the embodiment shown in FIGS. 1 and 2. The upper ends of rods 23 are closer to riser 15 than the lower ends of cylinders 19. Rods 23 are secured by spherical pins 29 to a top frame 31. Top frame 31 is mounted to a tension ring 33 that is clamped or otherwise secured to riser 15 for movement therewith. The radial distance from the axis of riser 15 to upper pins 29 is less than the radial distance from the riser axis to lower pins 25. The angle of each cylinder assembly 17 relative to the riser 15 will change as rods 23 stroke from a retracted position as shown in FIG. 2 to an extended position shown in FIG. 1. In FIG. 2, a wave or tidal variation has caused deck 11 to rise relative to riser 15, causing cylinder assembly 17 to retract. In FIG. 1, deck 11 has moved downward from that shown in FIG. 2 due to wave movement or tidal action. The pressurized gas over fluid (FIG. 1) maintains pressure on the lower side of piston 21 to cause cylinder assemblies 17 to extend.

Figure 3:
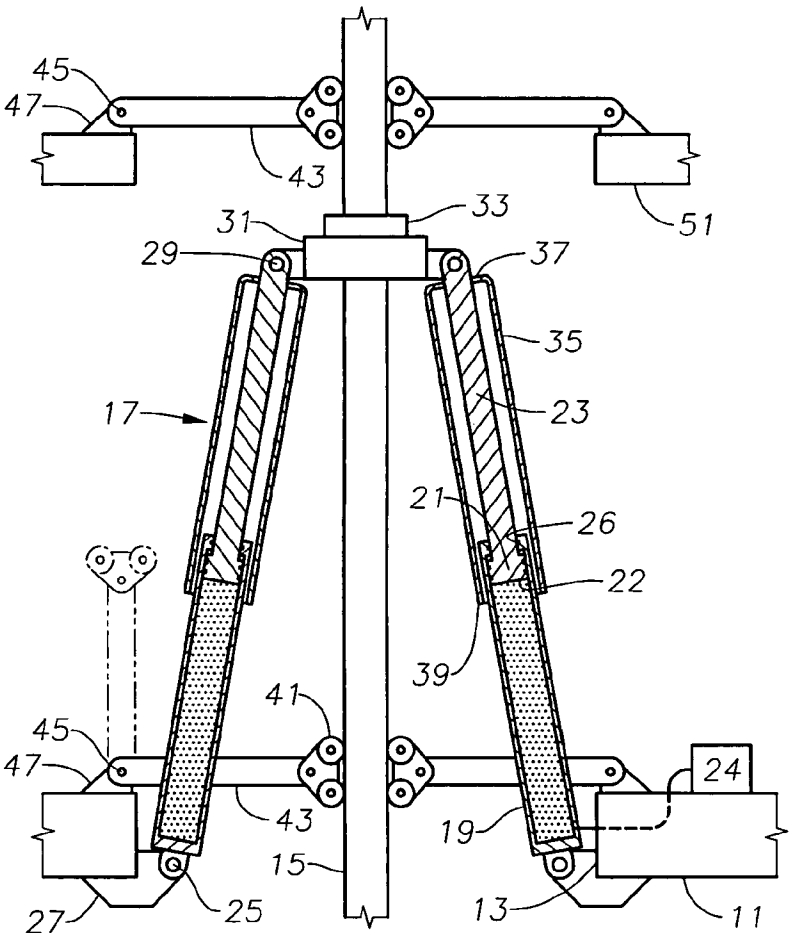
FIG. 3 is a schematic side view of an alternate embodiment of a riser tensioner in accordance with this invention and shown in an extended position.

A shroud 35 encloses the exposed portion of rod 23 of each cylinder assembly 17. Shroud 35 is a cylindrical member having a closed upper end 37 and an open lower end 39. Each rod 23 extends through a hole in closed end 37 that is preferably sealed to prevent corrosive fluids from contacting rod 23. Shroud 35 protects rod 23 and seals 26 from any debris falling onto cylinder assemblies 17 from above. The length of shroud 35 is selected so that lower end 39 will be close to the lower ends of cylinders 19 while cylinder assembly 17 is fully retracted as shown in FIG. 2. When fully extended, as shown in FIG. 3, lower end 39 of each shroud 35 is spaced below the upper end of cylinder 19. The interior of shroud 35 is at low or atmospheric pressure.

Sets of guide rollers 41 are employed to engage riser 15 and maintain riser 15 generally centralized in opening 13 but allow for angular offset of the riser relative to the platform. Although only two guide rollers 41 are shown, preferably more would be employed for each riser 15. Each guide roller 15 is mounted to an arm 43 that is fixed in length in the preferred embodiment. Arm 43 has an outer end that is secured by a pin 45 to a lug 47. Lug 47 mounts to deck 11 in this embodiment. Pivot pins 45 allow rods 43 to be pivoted and rotated away from deck opening 13 for other operations, such as when a larger diameter drilling riser is employed in a preliminary operation. In this embodiment, arms 43 are spaced above deck 11 only a short distance, thus provide centralizing to riser 15 at opening 13.

An upper deck 51 is located below tensioning ring 33 and above deck 11 in this embodiment. Mounting guide rollers to deck 51 reduces any moment arm on guide rollers 41 due to the failure of a cylinder assembly 17. Preventing angular movements are desirable during many workover and intervention operations. Preferably, pivot pins 45 allow rods 43 to be pivoted and rotated so that rollers 41 connected to upper deck 51 may be disengaged and pivoted away from riser 15. This may be desirable during operations where angular movements are allowable, or when a larger diameter drilling riser is employed.

The embodiment of FIG. 3 is the same as the embodiment of FIGS. 1 and 2 except for placement of guide rollers 41 and upper deck 51. Consequently, the same numerals will be used except for the different structure. In this embodiment, upper deck 51 is mounted above tension ring 33 and a considerable distance above deck 11. Arms 43 for guide rollers 41 are mounted to upper deck 51. An advantage of the embodiment of FIG. 3 occurs if one of the cylinder assemblies 17 loses pressure. A loss in pressure causes a bending moment arm to be applied to riser 15, which is resisted by guide rollers 41. Because of the placement above tension ring 33, the force applied by the moment arm is reduced over that which would exist if rollers 41 were placed as in FIGS. 1 and 2.

Figure 4:
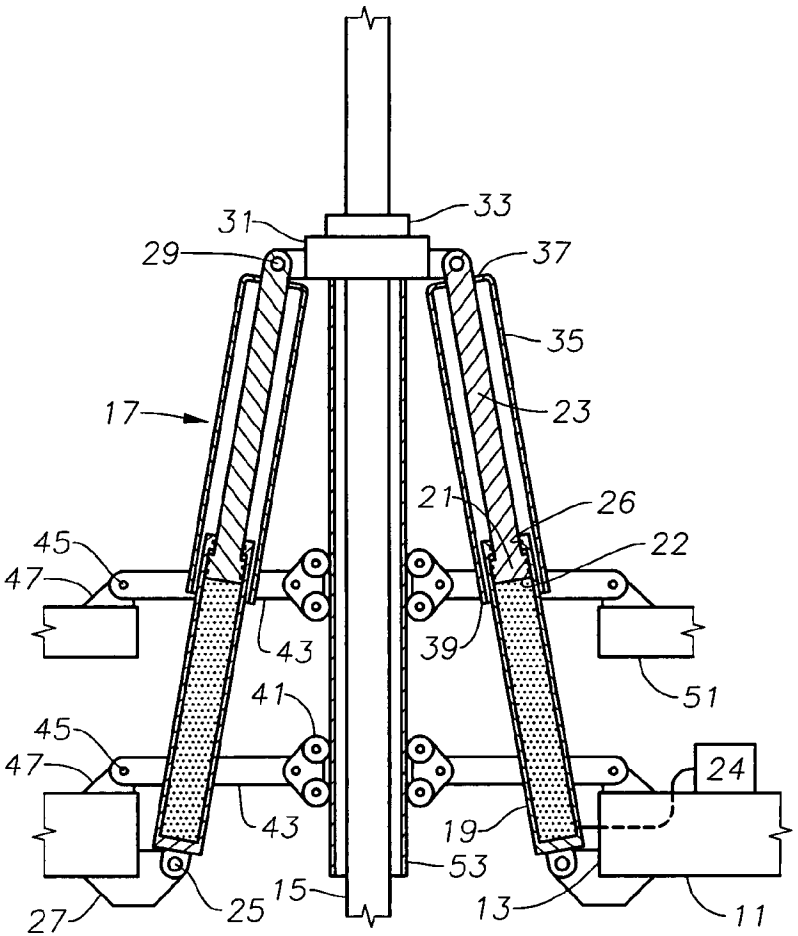
FIG. 4 is a schematic side view of an alternate embodiment of a riser tensioner in accordance with this invention and shown in an extended position.

The embodiment shown in FIG. 4 includes the use of a sleeve or conductor 53. Conductor 53 is mounted to top frame 31 and extends concentrically around riser 15. Conductor 53 extends downward a distance that is at least equal to the total stroke of cylinder assemblies 17. Guide rollers 41 engage conductor 53 rather than directly engaging riser 15. Conductor 53 provides wear protection to riser 15 due to contact with rollers 41.

Figure 5:
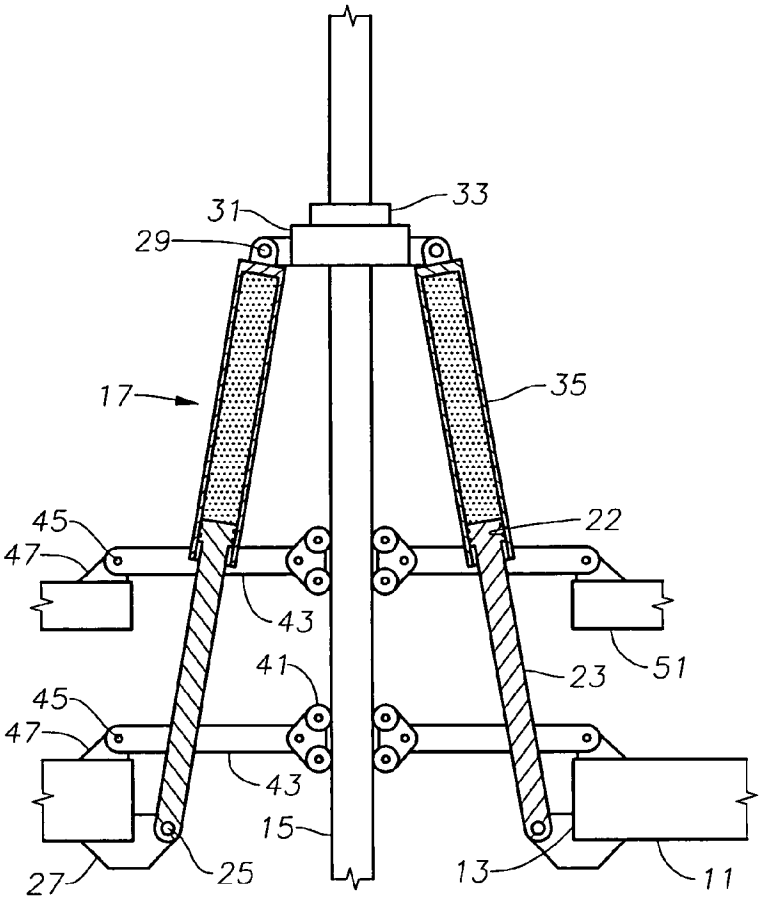
FIG. 5 is a schematic side view of an alternate embodiment of a riser tensioner in accordance with this invention and shown in an extended position.

Referring to the embodiment shown in FIG. 5, cylinder assemblies 17 are inverted in this alternative embodiment. Piston 21 sealingly engages the interior surface of cylinder 19 which contains pressurized gas as in the previously discussed embodiments. Cylinder 19 has an open lower end for receiving piston 21, but it does not sealingly engage rod 23 in this embodiment. Accordingly, the lower end of piston 21, below seals 22 is open to atmospheric pressure. Any fluid or debris dripping onto cylinder assembly 17 from above lands on cylinder 19, which protects the sealing region between seals 22 and the interior surface of cylinder 19. There is no separate surrounding rods 23 in this embodiment.

Figure 6:
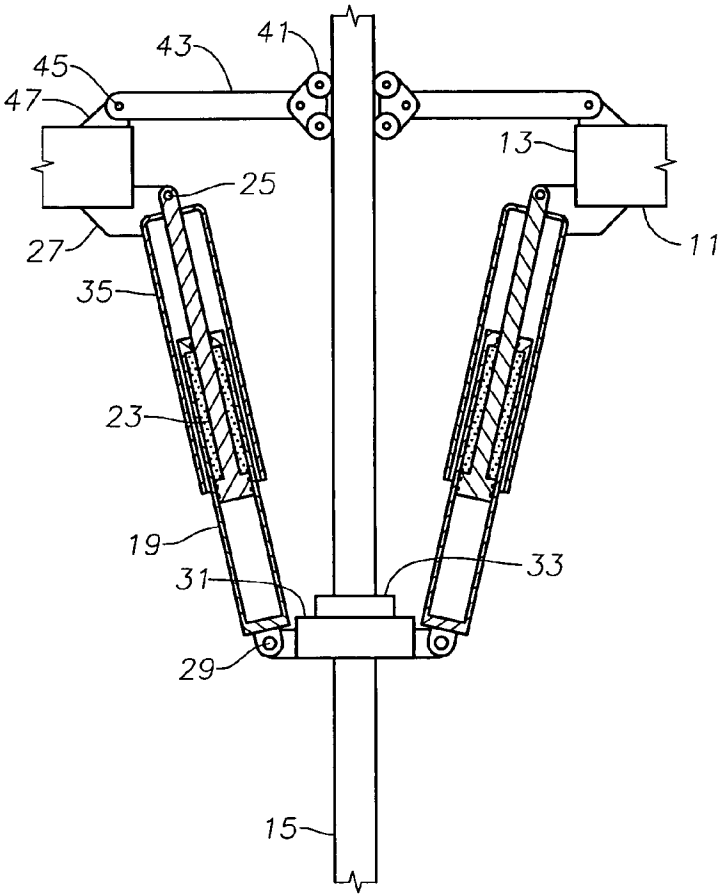
FIG. 6 is a schematic side view of an alternate embodiment of a riser tensioner in accordance with this invention and shown in a partially an extended position.

Referring to another alternative embodiment shown in FIG. 6, cylinder assemblies 17 and tension ring 33 are located below deck 11. Cylinder assemblies 17 extend downward at an angle so that the lower ends of cylinder assemblies 17 are radially inward and below the upper ends of cylinder assemblies 17. Shroud 35 continues to protect rod 23 from any debris falling onto cylinder assemblies 17 from above. This embodiment is particularly useful for replacing tensioner assemblies on existing structures, like existing tension leg platforms, wherein the tension ring is located below the deck. In this embodiment, gas over fluid pressure acts on the annular space between rod 23 and housing 19 to pull housing 19 upward.

In operation of the embodiments in FIGS. 1-5, tension ring 33 is mounted to riser 15, and guide rollers 41 are mounted in engagement with riser 15 or conductor 53 (FIG. 3). Gas pressure in cylinder 19 exerts a desired upward force on riser 15 to maintain a desired tension in riser 15. As deck 11 moves upward relative to riser 15, cylinder assemblies 17 retract. As deck 11 moves downward relative to riser 15, cylinder assemblies 17 extend.

In each of the embodiments, seals 22 are protected from drippings and debris from above while in both the contracted and retracted positions. Moreover, in the embodiments shown in FIGS. 1-4, and 6, shroud 35 also protects rod 23 and seals 26, in addition to the sealing region located between piston 21 and the interior surface of cylinder 19.

Figure 7:
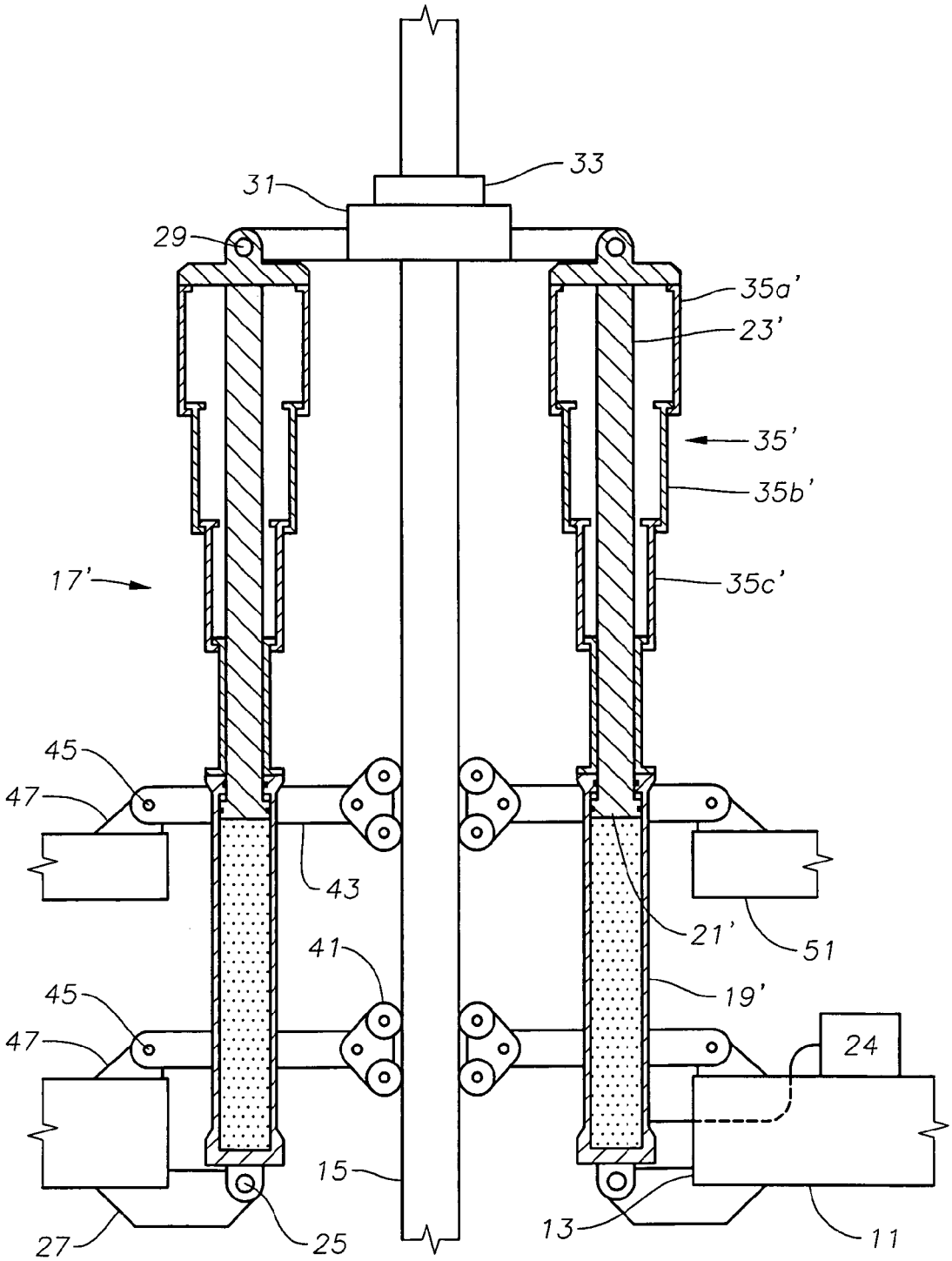
FIG. 7 is a schematic side view of another alternate embodiment of a riser tensioner in accordance with this invention and shown in an extended position.
Figure 8:
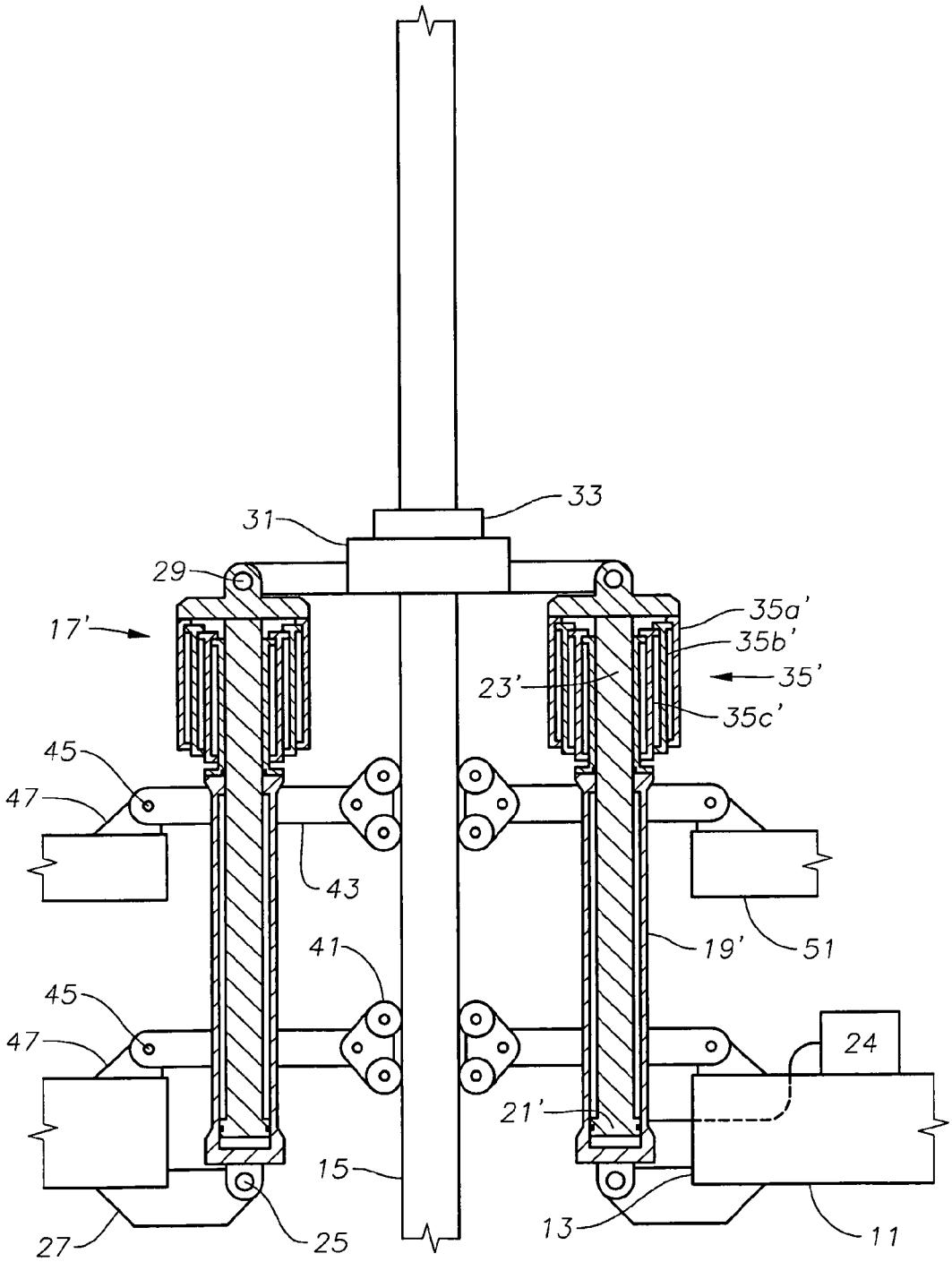
FIG. 8 is a schematic side view of the riser tensioner in FIG. 7, shown in a contracted position.
Figure 9:
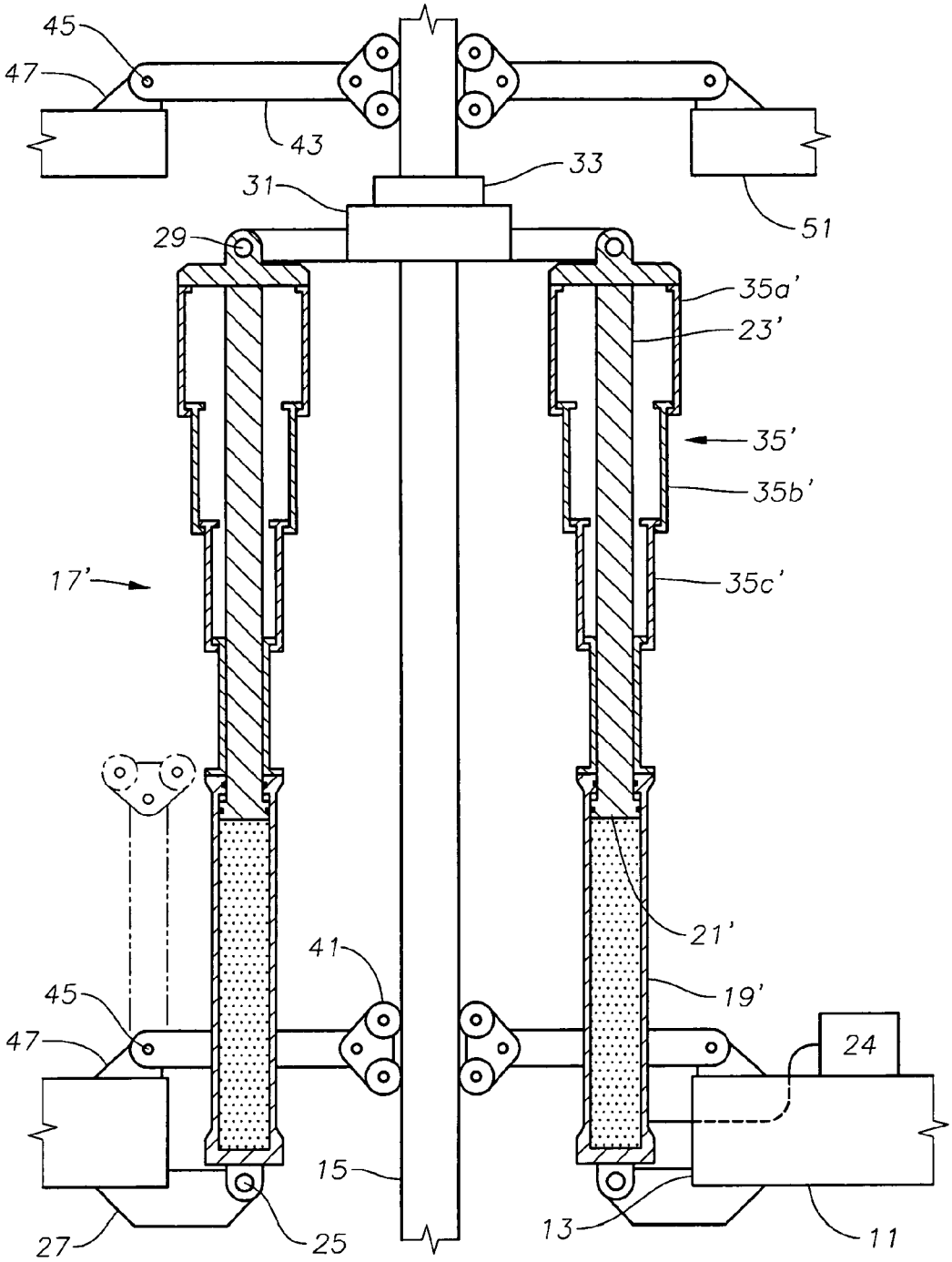
FIG. 9 is a schematic side view of another alternate embodiment of a riser tensioner in accordance with this invention and shown in an extended position.
Figure 10:
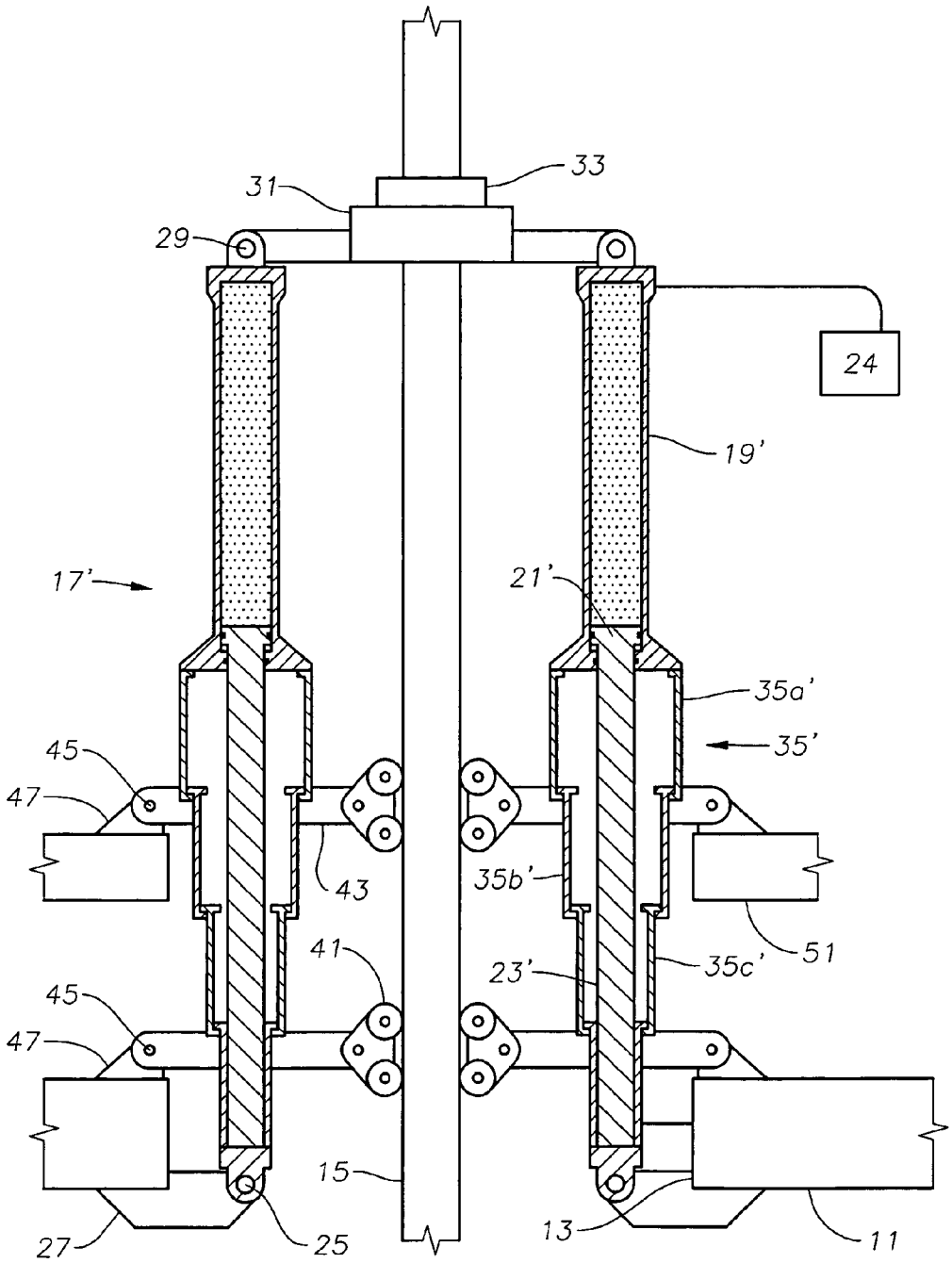
FIG. 10 is a schematic side view of another alternate embodiment of a riser tensioner in accordance with this invention and shown in an extended position.
Figure 11:
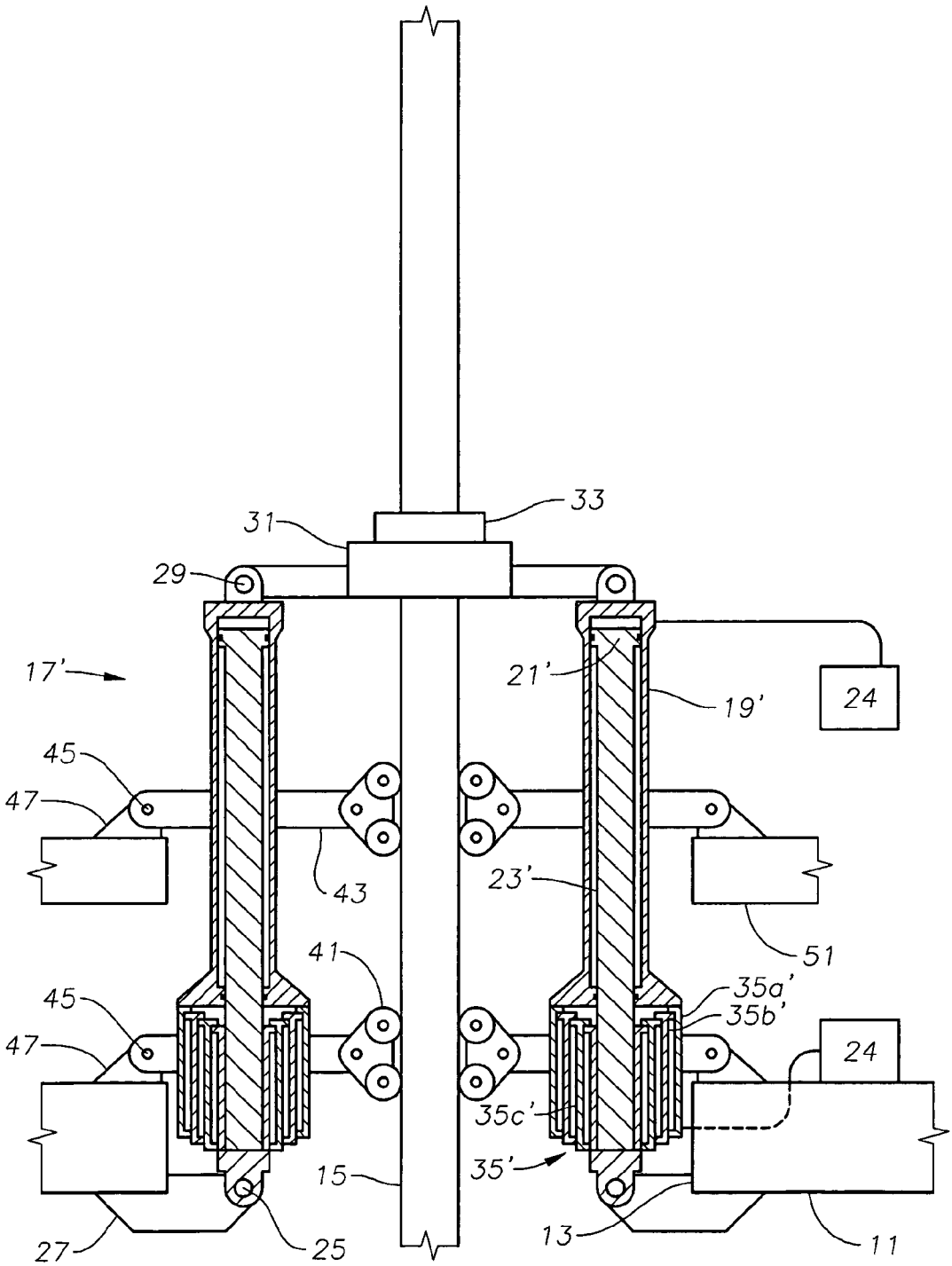
FIG. 11 is a schematic side view of the riser tensioner in FIG. 10, shown in a contracted position.

In the alternative embodiment of cylinder assembly 17' shown in FIGS. 7-11, shroud 35 is replaced with a shroud 35' having telescoping shroud portions 35*a*', 35*b*', 35*c*'. Similarly, piston and piston rod 21,23, and cylinder 19 from the embodiments shown in FIGS. 1-6 are replaced with piston 21', piston rod 23', and cylinder 19'. FIGS. 7 and 8 are similar to the embodiment shown in FIGS. 1 and 2, with upper deck 51 being positioned below engagement ring 31. FIG. 7 illustrates the alternative embodiment in an extended position, while FIG. 8 illustrates the alternative embodiment in a contracted position. Likewise, FIG. 9 is similar to the embodiment shown in FIG. 3 such that upper deck 51 is positioned above engagement ring. Finally, FIGS. 10-11 are similar to the embodiment shown FIG. 5, with cylinder 19' being disposed above piston rod 23' and shroud 35'. FIGS. 10 and 11 illustrate this alternative embodiment in both an extended and a contracted position. The alternative embodiments illustrated in FIGS. 7-11 also show cylinder assemblies 17' extending substantially vertical rather than extending at an angle radially inward from lower deck 11 to upper deck 51.

Referring to FIGS. 7-12, shroud 35' includes a plurality of tubular, telescoping shroud portions or segments 35*a*', 35*b*', and 35*c*'. In the preferred embodiment, outer shroud segment 35*a*' has an inner diameter larger enough to receive intermediate shroud segment 35*b*' and shroud segment 35*c*'. Intermediate shroud segment 35*b*' preferably has an inner diameter large enough to receive inner or small shroud segment 35*c*'. Outer or large shroud segment 35*a*' is preferably positioned above intermediate and small shroud segments 35*b*',35*c*' so that shroud 35' shields piston rod 23' from drippings from above when shroud 35' is both extended and contracted, whether cylinder is positioned below shroud 35' (FIGS. 7-9) or below shroud 35' (FIGS. 10-11).

Figure 12:
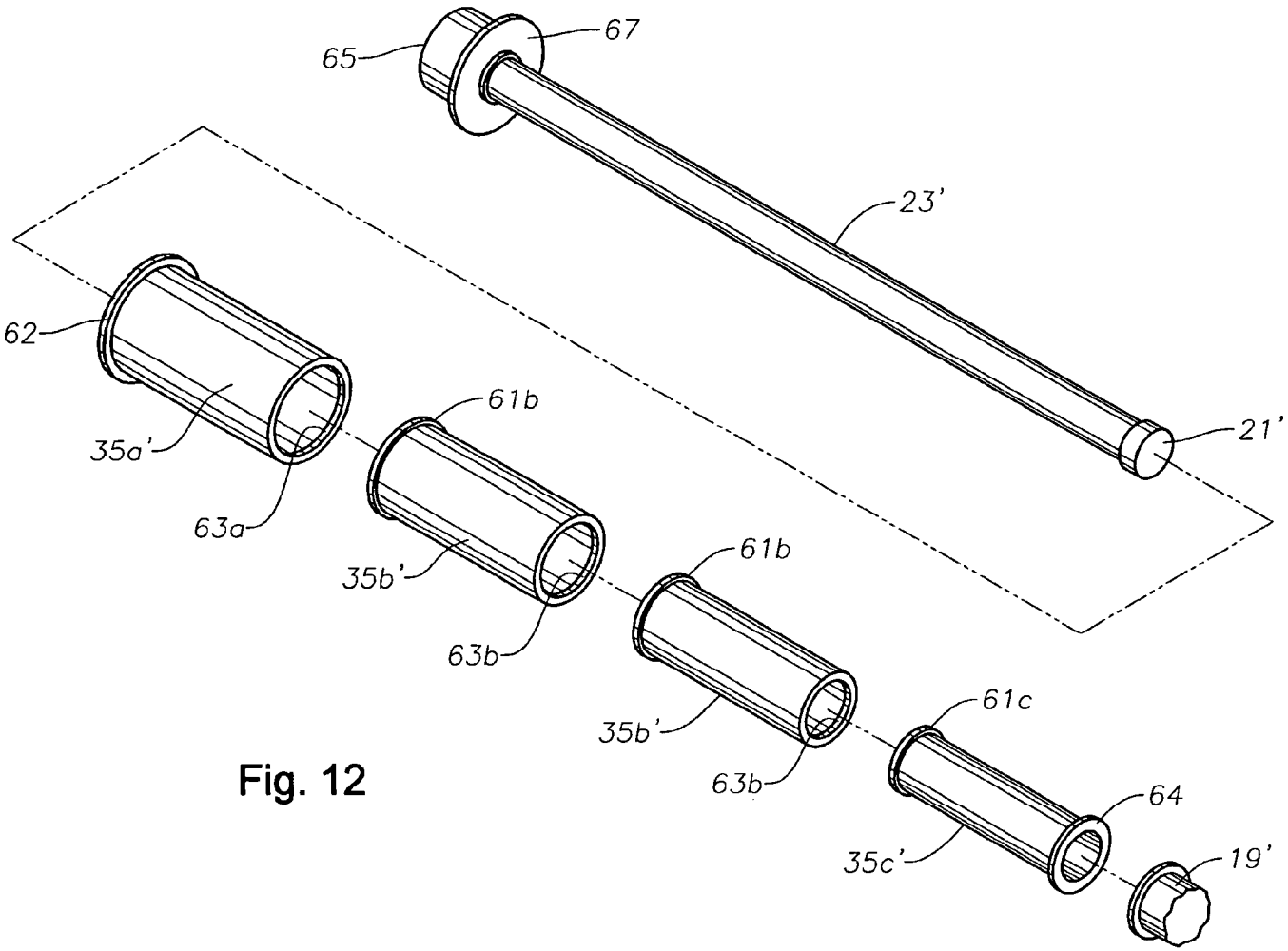
FIG. 12 is an exploded view of a cylinder assembly in the riser tensioner shown in FIGS. 7-9.

As is perhaps shown best in FIG. 12, shroud segments 35*a*',35*b*',35*c*' include upper and lower lips 61,63 for engaging each other when moving from the contracted position to the extended position. Lower lips 63 are preferably formed on an interior surface of the respective shroud segments for engaging an outer surface of another shroud segment disposed therein. Lower lips 63 are typically formed on a contraction end—or the end in the direction of movement of the shrouds during contraction—of each shroud segment. Upper lips 61 are preferably formed on an outer surface of the respective shroud segments for engaging an inner surface of another shroud. Typically, upper lips 61 are formed on an extension end—or the end in the direction of movement of the shrouds during extension—of each shroud segment. As will be appreciated by those skilled in the art, upper and lower lips 61,63 engage each other when shroud 35' is in its extended position and help to define the overall length of shroud 35' when extended.

In the preferred embodiment, each intermediate segment 35*b*' includes both upper and lower lips 61*b*,63*b* because each intermediate shroud segment receives a shroud segment, and is received by a larger shroud segment. In the preferred embodiment, large shroud segment 31*a*' includes only lower lip 63*a*, but has a flange 62 at its upper end for connecting to a piston rod connector flange 67 located on a piston rod connector 65 (FIGS. 7-9), or a flange located at the upper end portion of cylinder 19' (FIGS. 10-11). In the preferred embodiment, small shroud segment 35*c*' only includes upper lip 63*c*. However, small shroud segment 35*c*' also includes a flange 64 at its lower end for connecting to a flange located at the upper end portion of cylinder 19' (FIGS. 7-9) or to piston rod connector flange 67 (FIGS. 10-11).

In the embodiments shown in FIGS. 7-12, piston rod 23' is at least one shroud length longer than piston rod 23 in the previous embodiments because no shroud segment telescope over cylinder 19'. As will be readily appreciated by those skilled in the art, in the embodiment shown in FIGS. 7-9, small shroud segment 35*c*' could be adapted to telescope over an outer surface of cylinder 19', for example with a lower lip 63 rather than a flange 64, so that piston rod 23' could have substantially the same length as piston rod 23.

In each of the alternative embodiments illustrated in FIGS. 7-12, the seals of pistons 21' are protected from drippings and debris from above while in both the contracted and retracted positions. Moreover, in each of the embodiments shown in FIGS. 7-12, shroud 35' also protects rod 23' and the seals that engage rod 23', in addition to the sealing region located between piston 21' and the interior surface of cylinder 19. Protecting the outer surface of piston rod 23' allows for a less expensive manufacture of piston rod 23' because a protective layer will not be necessary.

While the invention has been shown in only three of its forms, it should be apparent to those skilled in the art that it is not so limited but is susceptible to various changes without departing from the scope of the invention. For example, the number of intermediate shrouds 35*b*' can be increased or decreased, even such that large shroud 35*a*' registers with small shroud 35*b*'. Furthermore, the telescoping shroud segments could also be utilized with the tensioner assemblies having the piston rod extending radially inward from the working deck to the tension ring.

That claimed is:

1. A riser tensioning system for applying tension to a riser extending from subsea equipment to a floating platform, comprising:

a tension ring assembly coupleable to the riser to enable a force applied to the tension ring assembly to be transferred to the riser;

a plurality of cylinder assemblies, each of the cylinder assemblies comprising:

a cylinder a piston carried slidably within the cylinder and a piston rod joining the piston and extending from the cylinder, each of the cylinder assemblies having one end pivotally mounted to the tension ring assembly and one end to be pivotally mounted to the floating platform, the cylinder being pressurized with fluid pressure below the piston to apply an upward force through the piston rod and tension ring assembly to the riser;

a tubular shroud assembly having at least two shroud segments extending around the piston rod; and wherein one end of the tubular shroud assembly is secured to the cylinder and the other to the piston rod for movement therewith, the shroud segments telescoping relative to one another when the piston moves relative to the cylinder.

2. The tensioning system according to claim 1, wherein an upper one of the shroud segments has a larger inner diameter than an outer diameter of a lower one of the shroud segments, and the outer diameter of the lower one of the shroud segments is in sliding engagement with the inner diameter of the upper one of the shroud segments.

3. The tensioning system according to claim 1, wherein a length of each of the shroud segments is less than a length of the piston rod.

4. The tensioning system according to claim 1, wherein the end of the tubular shroud assembly secured to the cylinder is located below the end of the tubular shroud assembly secured to the rod.

5. The tensioning system according to claim 1, further comprising:

a seal on one end of the cylinder that seals around the piston rod.

6. The tensioning system according to claim 1, wherein said at least two shroud segments comprise:

at least one tubular intermediate shroud segment located between upper and lower shroud segments, the intermediate shroud segment telescoping relative to the upper and the lower shroud segments when the piston moves relative to the cylinder.

7. A riser tensioning system for applying tension to a riser extending from subsea equipment to a floating platform, comprising:

a brace assembly adapted to be mounted to a deck of the floating platform about an opening through which the riser extends;

a tension ring assembly adapted to be mounted to the riser above the brace assembly to enable an upward force applied to the tension ring assembly to be transferred to the riser;

a plurality of cylinder assemblies, each of the cylinder assemblies comprising:

a cylinder, a piston carried slidably within the cylinder a piston rod joining the piston and extending from the cylinder one end of each of the cylinder assemblies being mounted to the brace assembly and another end to the tension ring assembly, the cylinder being pressurized with fluid pressure below the piston to apply an upward force through the piston rod and tension ring assembly to the riser; and a telescoping shroud assembly enclosing the piston rod and being retractable and extendable as the piston rod extends and retracts relative to the cylinder, the telescoping shroud assembly having at least two tubular shroud segments, an upper one of the shroud segments being larger in inner diameter than an outer diameter of a lower one of the shroud segments.

8. The tensioner system according to claim 7, wherein the piston rod has a greater length than a length of the telescoping shroud assembly when the telescoping shroud assembly is fully extended.

9. The tensioner system according to claim 7, wherein the upper one of the shroud is mounted to the piston rod for movement therewith, and the lower one of the shroud segments is mounted to the cylinder for movement therewith.

10. The tensioner system according to claim 9, wherein when the telescoping shroud assembly is fully retracted, an upper end of the lower one of the shroud segments will be spaced above an upper end of the cylinder by a length of the lower one of the shroud segments.

11. The tensioning system according to claim 9, wherein the telescoping shroud assembly further comprises:

at least one tubular intermediate shroud segment between the upper and the lower ones of the shroud segments, the intermediate shroud segment telescoping relative to the upper and the lower ones of the shroud segments when the piston moves relative to the cylinder.

12. A method of applying tension to a riser extending from subsea equipment through an opening in a floating platform, comprising:

(a) mounting a plurality of cylinder assemblies around the opening between the riser and the platform, each of the cylinder assemblies having a cylinder, a piston carried slidably within the cylinder, and a piston rod joining the piston and extending from the cylinder;

(b) mounting a telescoping shroud assembly around each of the piston rods with one end of the telescoping shroud assembly mounted to the piston rod and another end of the telescoping shroud assembly mounted to the cylinder, the telescoping shroud assembly having at least two tubular shroud segments that telescope relative to one another;

(c) applying fluid pressure to each of the cylinders below each of the pistons, thereby causing an upward force to pass through each of the piston rods to the riser;

(d) when the floating platform moves upward relative to the riser, allowing of each of the piston rods and each of telescoping shroud assemblies to retract; and (e) when the floating platform moves downward relative to the riser, allowing each of the telescoping shroud assemblies and each of the piston rods to extend.

13. The method according to claim 12, wherein step (c) causes a compressive force to be applied to each of the piston rods.

14. The method according to claim 12, wherein step (b) further comprises providing an upper one of the shroud segments with a larger inner diameter than an outer diameter of a lower one of the shroud segments.

15. The method according to claim 12, wherein during step (b) providing the tubular shroud assembly with at least two tubular shroud segments comprises providing the tubular shroud assembly with three tubular shroud segments.

* * * * *